US009142133B2

(12) United States Patent
Palanisamy et al.

(10) Patent No.: US 9,142,133 B2
(45) Date of Patent: Sep. 22, 2015

(54) SYSTEM AND METHOD FOR MAINTAINING AIRCRAFT SEPARATION BASED ON DISTANCE OR TIME

(71) Applicant: HONEYWELL INTERNATIONAL INC., Morristown, NJ (US)

(72) Inventors: Dhivagar Palanisamy, Phoenix, AZ (US); Saravanakumar Gurusamy, Tamil Nadu (IN); Vishnu Vardhan Reddy Annapureddy, Karnataka (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 19 days.

(21) Appl. No.: 14/065,655

(22) Filed: Oct. 29, 2013

(65) Prior Publication Data

US 2015/0120177 A1 Apr. 30, 2015

(51) Int. Cl.
*G08G 1/0967* (2006.01)
*G08G 5/00* (2006.01)

(52) U.S. Cl.
CPC ..... *G08G 5/0021* (2013.01)

(58) Field of Classification Search
CPC ... G08G 5/0021; G08G 5/003; G08G 5/0095; G01C 23/00
USPC ..... 701/120, 3, 4, 5
See application file for complete search history.

(56) References Cited

U.S. PATENT DOCUMENTS

| | | | | |
|---|---|---|---|---|
| 7,570,178 | B1 | 8/2009 | Whalen et al. | |
| 8,315,787 | B2 | 11/2012 | Shafaat et al. | |
| 8,417,396 | B2 * | 4/2013 | Goodman et al. | 701/3 |
| 2004/0143393 | A1 * | 7/2004 | Knecht et al. | 701/301 |
| 2006/0004496 | A1 * | 1/2006 | Tucker et al. | 701/4 |
| 2007/0020588 | A1 * | 1/2007 | Batcheller et al. | 434/30 |
| 2010/0152996 | A1 | 6/2010 | Blanchon et al. | |
| 2011/0046869 | A1 | 2/2011 | Goodman et al. | |
| 2011/0066362 | A1 * | 3/2011 | He | 701/120 |
| 2011/0316857 | A1 * | 12/2011 | Pepitone et al. | 345/467 |
| 2012/0010763 | A1 * | 1/2012 | Goodman et al. | 701/2 |
| 2013/0113635 | A1 | 5/2013 | Whitlow et al. | |
| 2013/0144518 | A1 | 6/2013 | Dacre-Wright et al. | |

OTHER PUBLICATIONS

All Aspect Aerospace Innovations, LLC; Interval Management Users Guide [IM-NOVA Study 2012]; Revision 004, Jul. 2012.

Stassen, H. et al.; The MITRE Corporation, McLean, VA.; Multi-Purpose Cockpit Display of Traffic Information: Overview and Development of Performance Requirements; American Institute of Aeronautics and Astronautics. Approved for Public Release; Distribution Unlimited Case # 10-2768.

(Continued)

*Primary Examiner* — Mary Cheung
*Assistant Examiner* — Frederick Brushaber
(74) *Attorney, Agent, or Firm* — Ingrassia Fisher & Lorenz, P.C.

(57) ABSTRACT

A system and method are provided for displaying an enhanced longitudinal scale providing user interface and awareness for executing the Next Gen Flight Deck Interval Management (FIM) and the Cockpit Display of Traffic Information (CDTI) application Enhanced Visual Separation on Approach (VSA) to provide a required spacing between aircraft based on distance and time. An own-ship and a reference aircraft are displayed in relation to a desired flight path. A symbol indicates the desired separation of the own-ship from the aircraft.

18 Claims, 9 Drawing Sheets

(56) References Cited

OTHER PUBLICATIONS

Massia, R.; Surveillance and Broadcast Services, ASAS in NextGen; Federal Aviation Administration, Apr. 24, 2007.

EP Extended Search Report for Application EP 14186715.0 dated Mar. 5, 2015.

EP Examination Report for Application EP 14186715.0 dated Jul. 16, 2015.

* cited by examiner

SYSTEM AND METHOD FOR MAINTAINING AIRCRAFT SEPARATION BASED ON DISTANCE OR TIME

TECHNICAL FIELD

The exemplary embodiments described herein generally relates to aircraft display systems and more particularly to the display of information for maintaining separation of airborne aircraft based on distance or time.

BACKGROUND

It is important for pilots to know the position of other aircraft in their airspace that may present a hazard to safe flight. Typical displays that illustrate other aircraft show text to provide important information such as altitude and speed. This text occupies much of the screen when there are several aircraft being displayed, thereby increasing the chance for confusion. Furthermore, the pilot must interpret the information provided in the text occupying his thought processes when he may have many other decisions to make.

With increased availability of Automated Dependent Surveillance Broadcast (ADSB) installations, Cockpit Display of Traffic Information (CDTI) displays can show surrounding traffic with increased accuracy and provide improved situation awareness. In the ADSB system, aircraft transponders receive GPS signals and determine the aircraft's precise position, which is combined with other data and broadcast out to other aircraft and air traffic controllers. This display of surrounding traffic increases the pilot's awareness of traffic over and above that provided by Air Traffic Control. One known application allows approach in-trail procedures and enhanced visual separation and stationery keeping. With the CDTI display, flight crews can find the in-trail target on the display and then follow the target. However, when the number of ADSB targets becomes numerous, particularly in the vicinity of an airport, identifying a specific target efficiently on a CDTI display can be time consuming. For in-trail targets, pilots are typically given a tail number by ATC, which must often be typed into the CDTI display by the pilot. This procedure allows for errors by the pilot potentially typing in the incorrect number and is time consuming.

Two upcoming applications that empower the pilot to maintain separation independently during cruise and approach are the Next Gen Flight Deck Interval Management (FIM) application and the CDTI application Enhanced Visual Separation on Approach (VSA). Both applications pair the own-ship with another 'target' or 'reference' aircraft and the flight crew is responsible for maintaining separation. The FIM relies on maintaining separation based on time. The CDTI VSA application relies on maintaining separation based on distance rather than time. These pilot controlled/delegated applications help in reducing the separation needed and thereby increase the capacity at an airport. Current cockpit displays do not have symbology that provides awareness of separation with another aircraft. There is no industry standard for a longitudinal scale.

Accordingly, it is desirable to provide a symbology that can display the aircraft separation and that can also be intuitive such that pilot can use it regardless of whether the desired separation is displayed based on time or distance. The symbology would also provide enough awareness/indications of the target aircraft deviations from flight plan and the target aircraft's next intended maneuver. Furthermore, other desirable features and characteristics of the exemplary embodiments will become apparent from the subsequent detailed description and the appended claims, taken in conjunction with the accompanying drawings and the foregoing technical field and background.

BRIEF SUMMARY

A system and method display a symbology that can display aircraft separation and that can also be intuitive such that pilot can use it regardless of whether the desired separation is displayed based on time or distance.

In an exemplary embodiment, a method for displaying a desired separation of an own-ship from an aircraft, comprises displaying a desired flight path, displaying a position of the own-ship in relation to the desired flight path, displaying a position of the aircraft in relation to the desired flight path, displaying a symbol in relation to the desired flight path that indicates the desired separation of the aircraft from the own-ship.

In another exemplary embodiment, a method for displaying a desired separation of an own-ship from an aircraft, comprises displaying a longitudinal scale representing a desired flight path, displaying a position of the own-ship in relation to the desired flight path, displaying a position of the aircraft in relation to the desired flight path, displaying a symbol in relation to the desired flight path that indicates the desired separation of the aircraft from the own-ship.

In yet another exemplary embodiment, a system for displaying a desired separation of an own-ship from an aircraft, comprises a display, a navigation system configured to determine a location of the own-ship and the aircraft, a processor coupled to the display and the navigation system, and configured to display a desired flight path, display a position of the own-ship in relation to the desired flight path, display a position of the aircraft in relation to the desired flight path; display a symbol in relation to the desired flight path that indicates the desired separation of the aircraft from the own-ship

BRIEF DESCRIPTION OF THE DRAWINGS

The present invention will hereinafter be described in conjunction with the following drawing figures, wherein like numerals denote like elements.

DETAILED DESCRIPTION

Figure 1:
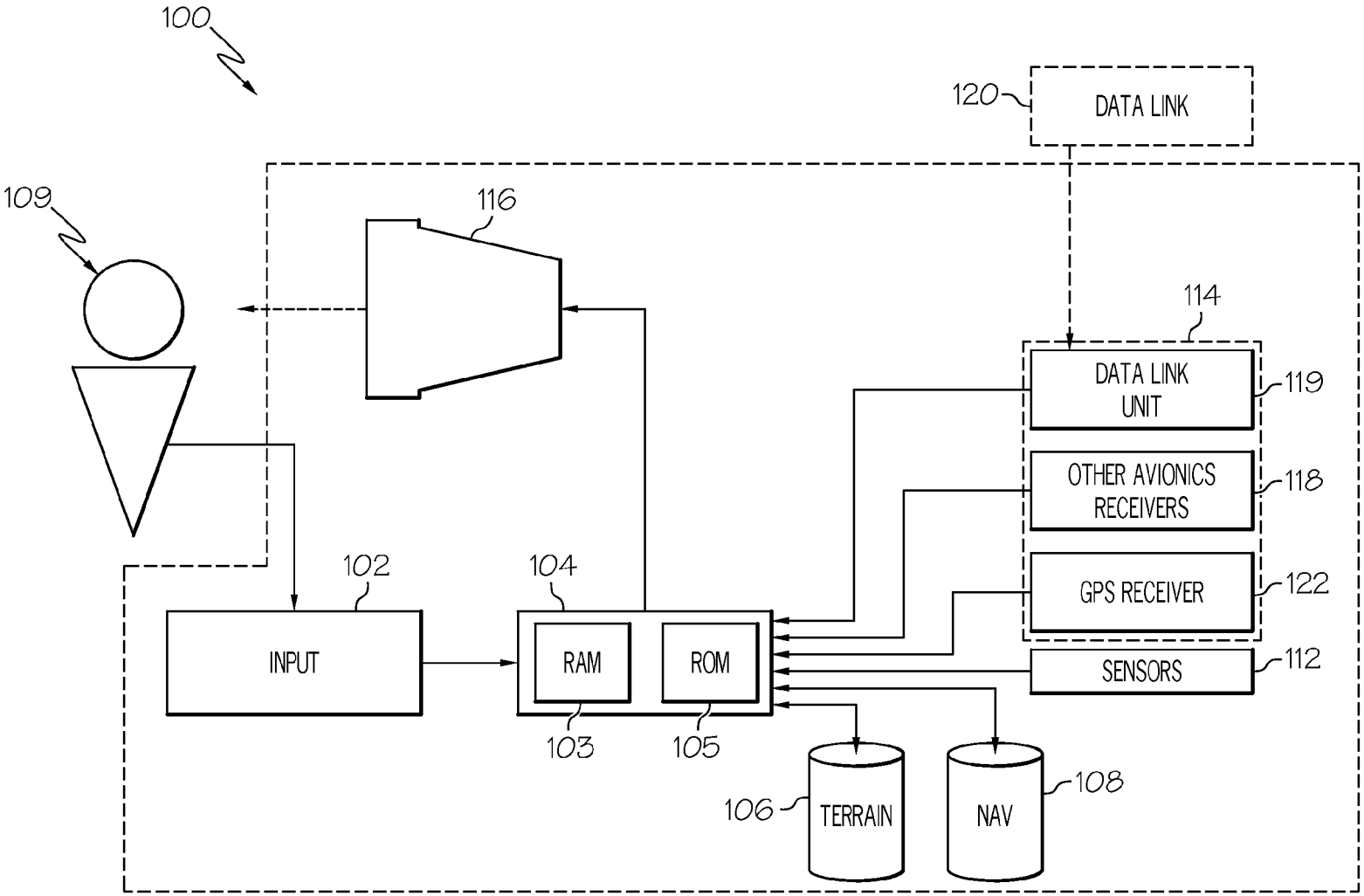
FIG. 1 is a block diagram of a known display system suitable for use in an aircraft in accordance with the exemplary embodiments described herein.

The following detailed description is merely illustrative in nature and is not intended to limit the embodiments of the subject matter or the application and uses of such embodiments. Any implementation described herein as exemplary is not necessarily to be construed as preferred or advantageous over other implementations. Furthermore, there is no intention to be bound by any expressed or implied theory presented in the preceding technical field, background, brief summary, or the following detailed description.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. The word "exemplary" is used exclusively herein to mean "serving as an example, instance, or illustration." Any embodiment described herein as "exemplary" is not necessarily to be construed as preferred or advantageous over other embodiments. Any of the above devices are exemplary, non-limiting examples of a computer readable storage medium.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal. Any of the above devices are exemplary, non-limiting examples of a computer readable storage medium.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

For the sake of brevity, conventional techniques related to graphics and image processing, navigation, flight planning, aircraft controls, aircraft data communication systems, and other functional aspects of certain systems and subsystems (and the individual operating components thereof) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The following description refers to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements, additional intervening elements, devices, features, or components may be present in an embodiment of the depicted subject matter. In addition, certain terminology may also be used in the following description for the purpose of reference only, and thus are not intended to be limiting.

Although embodiments described herein are specific to aircraft display systems, it should be recognized that principles of the inventive subject matter may be applied to other vehicle display systems such as displays in sea going vessels and displays used by off-site controllers, e.g., ground controllers.

Some applications may require more than one monitor, for example, a head down display screen, to accomplish the mission. These monitors may include a two dimensional moving map display and a three dimensional perspective display. A moving map display may include a top-down view of the aircraft, the flight plan, and the surrounding environment. Various symbols are utilized to denote navigational cues (e.g., waypoint symbols, line segments interconnecting the waypoint symbols, range rings) and nearby environmental features (e.g., terrain, weather conditions, political boundaries, etc).

Alternate embodiments of the present invention to those described below may utilize whatever navigation system signals are available, for example a ground based navigational system, a GPS navigation aid, a flight management system, and an inertial navigation system, to dynamically calibrate and determine a precise course.

Referring to FIG. 1, an exemplary flight deck display system 100 is depicted and will be described for displaying an icon representing spacing between aircraft in accordance with the exemplary embodiments. The system 100 includes a user interface 102, a processor 104, one or more terrain/taxiway databases 106, one or more navigation databases 108, various optional sensors 112 (for the cockpit display version), various external data sources 114, and a display device 116. In some embodiments the user interface 102 and the display device 116 may be combined in the same device, for example, a touch pad. The user interface 102 is in operable communication with the processor 104 and is configured to receive input from a user 109 (e.g., a pilot) and, in response to the user input, supply command signals to the processor 104. The user interface 102 may be any one, or combination, of various known user interface devices including, but not limited to, a cursor control device (CCD) 107, such as a mouse, a trackball, or joystick, and/or a keyboard, one or more buttons, switches, or knobs.

The processor 104 may be any one of numerous known general-purpose microprocessors or an application specific processor that operates in response to program instructions. In the depicted embodiment, the processor 104 includes on-board RAM (random access memory) 103, and on-board ROM (read only memory) 105. The program instructions that control the processor 104 may be stored in either or both the RAM 103 and the ROM 105. For example, the operating system software may be stored in the ROM 105, whereas various operating mode software routines and various operational parameters may be stored in the RAM 103. It will be appreciated that this is merely exemplary of one scheme for storing operating system software and software routines, and that various other storage schemes may be implemented. It will also be appreciated that the processor 104 may be implemented using various other circuits, not just a programmable processor. For example, digital logic circuits and analog signal processing circuits could also be used.

No matter how the processor 104 is specifically implemented, it is in operable communication with the terrain/taxiway databases 106, the navigation databases 108, and the display device 116, and is coupled to receive various types of inertial data from the various sensors 112, and various other avionics-related data from the external data sources 114. The processor 104 is configured, in response to the inertial data and the avionics-related data, to selectively retrieve terrain data from one or more of the terrain/taxiway databases 106 and navigation data from one or more of the navigation databases 108, and to supply appropriate display commands to the display device 116. The display device 116, in response to the display commands from, for example, a touch screen, keypad, cursor control, line select, concentric knobs, voice control, and datalink message, selectively renders various types of textual, graphic, and/or iconic information. The preferred manner in which the textual, graphic, and/or iconic information are rendered by the display device 116 will be described in more detail further below. Before doing so, however, a brief description of the databases 106, 108, the sensors 112, and the external data sources 114, at least in the depicted embodiment, will be provided.

The terrain/taxiway databases 106 include various types of data representative of the surface over which the aircraft is taxing, the terrain over which the aircraft is flying, and the navigation databases 108 include various types of navigation-related data. These navigation-related data include various flight plan related data such as, for example, waypoints, distances between waypoints, headings between waypoints, data related to different airports, navigational aids, obstructions, special use airspace, political boundaries, communication frequencies, and aircraft approach information. It will be appreciated that, although the terrain/taxiway databases 106 and the navigation databases 108 are, for clarity and convenience, shown as being stored separate from the processor 104, all or portions of either or both of these databases 106, 108 could be loaded into the RAM 103, or integrally formed as part of the processor 104, and/or RAM 103, and/or ROM 105. The terrain/taxiway databases 106 and navigation databases 108 could also be part of a device or system that is physically separate from the system 100.

The sensors 112 may be implemented using various types of inertial sensors, systems, and or subsystems, now known or developed in the future, for supplying various types of inertial data. The inertial data may also vary, but preferably include data representative of the state of the aircraft such as, for example, aircraft speed, heading, altitude, and attitude. The number and type of external data sources 114 may also vary. For example, the external systems (or subsystems) may include, for example, a terrain avoidance and warning system (TAWS), a traffic and collision avoidance system (TCAS), a runway awareness and advisory system (RAAS), a flight director, and a navigation computer, just to name a few. However, for ease of description and illustration, only an onboard datalink unit 119 and a global position system (GPS) receiver 122 are depicted in FIG. 1, and will now be briefly described.

The GPS receiver 122 is a multi-channel receiver, with each channel tuned to receive one or more of the GPS broadcast signals transmitted by the constellation of GPS satellites (not illustrated) orbiting the earth. Each GPS satellite encircles the earth two times each day, and the orbits are arranged so that at least four satellites are always within line of sight from almost anywhere on the earth. The GPS receiver 122, upon receipt of the GPS broadcast signals from at least three, and preferably four, or more of the GPS satellites, determines the distance between the GPS receiver 122 and the GPS satellites and the position of the GPS satellites. Based on these determinations, the GPS receiver 122, using a technique known as trilateration, determines, for example, aircraft position, groundspeed, and ground track angle. These data may be supplied to the processor 104, which may determine aircraft glide slope deviation therefrom. Preferably, however, the GPS receiver 122 is configured to determine, and supply data representative of, aircraft glide slope deviation to the processor 104.

The display device 116, as noted above, in response to display commands supplied from the processor 104, selectively renders various textual, graphic, and/or iconic information, and thereby supply visual feedback to the user 109. It will be appreciated that the display device 116 may be implemented using any one of numerous known display devices suitable for rendering textual, graphic, and/or iconic information in a format viewable by the user 109. Non-limiting examples of such display devices include various cathode ray tube (CRT) displays, and various flat panel displays such as various types of LCD (liquid crystal display) and TFT (thin film transistor) displays. The display device 116 may additionally be implemented as a panel mounted display, a HUD (head-up display) projection, or any one of numerous known technologies. It is additionally noted that the display device 116 may be configured as any one of numerous types of aircraft flight deck displays. For example, it may be configured as a multi-function display, a horizontal situation indicator, or a vertical situation indicator, just to name a few. In the depicted embodiment, however, the display device 116 is configured as a primary flight display (PFD).

In an exemplary embodiment, the data link unit 119 is suitably configured to support data communication between the host aircraft and one or more remote systems via a data link 120. More specifically, the data link unit 119 is used to receive current flight status data of other aircraft that are near the host aircraft. In particular embodiments, the data link unit 119 is implemented as an aircraft-to-aircraft data communication module that receives flight status data from an aircraft other than the host aircraft. For example, the data link unit 119 may be configured for compatibility with Automatic Dependent Surveillance-Broadcast (ADS-B) technology, with Traffic and Collision Avoidance System (TCAS) technology, and/or with similar technologies.

In operation, the display system 100 is also configured to process the current flight status data for the host aircraft. In this regard, the sources of flight status data generate, measure, and/or provide different types of data related to the operational status of the host aircraft, the environment in which the host aircraft is operating, flight parameters, and the like. In practice, the sources of flight status data may be realized using line replaceable units (LRUs), transducers, accelerometers, instruments, sensors, and other well-known devices. The data provided by the sources of flight status data may include, without limitation: airspeed data; groundspeed data; altitude data; attitude data, including pitch data and roll data; yaw data; geographic position data, such as GPS data; time/date information; heading information; weather information; flight path data; track data; radar altitude data; geometric altitude data; wind speed data; wind direction data; etc. The display system 100 is suitably designed to process data obtained from the sources of flight status data in the manner described in more detail herein. In particular, the display system 100 can use the flight status data of the host aircraft when rendering the ITP display.

It should be understood that FIG. 1 is a simplified representation of a display system 100 for purposes of explanation and ease of description, and FIG. 1 is not intended to limit the application or scope of the subject matter in any way. In practice, the display system 100 and/or aircraft will include numerous other devices and components for providing additional functions and features, as will be appreciated in the art.

In accordance with the exemplary embodiments, an enhanced longitudinal scale provides a better user interface and awareness for executing the Next Gen Flight Deck Interval Management (FIM) and the CDTI application Enhanced Visual Separation on Approach (VSA) to provide a required spacing between aircraft.

Figure 2:
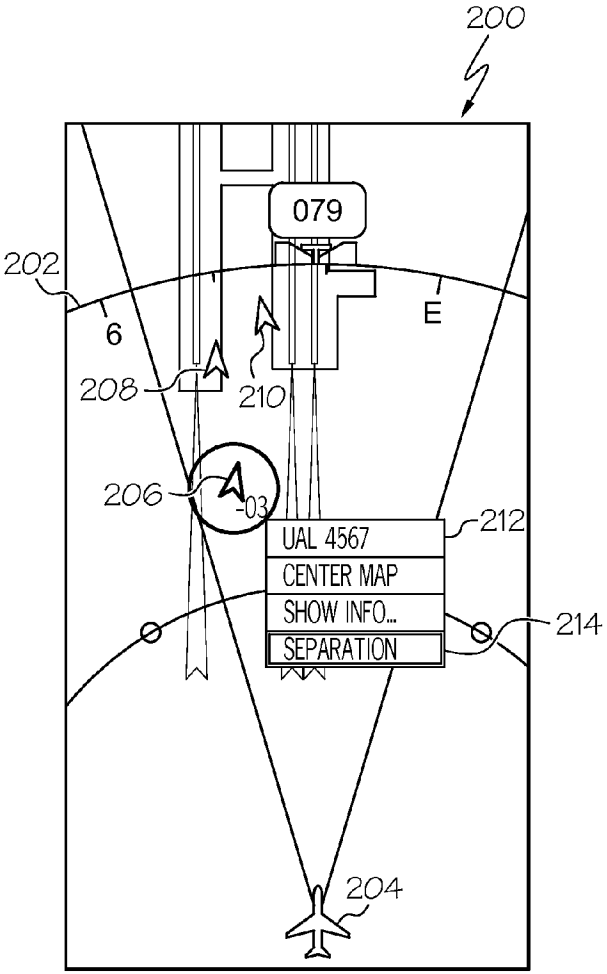
FIG. 2 is a first image displayed in accordance with a first exemplary embodiment that may be rendered on the flight display system of FIG. 1.

With reference to FIG. 2, the display 116 includes a display area 200 in which multiple graphical images may be simultaneously displayed, for example, a heading indicator 202. Although a top down view is depicted, it is understood that a vertical, or perspective, view could be depicted in accordance with the exemplary embodiments. Additional information (not shown) is typically provided in either graphic or numerical format. The display area 200 may also include navigational aids, such as a navigation reference and various map features (not shown) including, but not limited to, terrain, political boundaries, and terminal and special use airspace areas, which, for clarity, are not shown in FIG. 2. A symbol 204 is displayed as the own-ship which contains the flight deck display system 100 in accordance with this exemplary embodiment. The location of the symbol of the own-ship 204 may be determined, for example, from a GPS, and for other aircraft 206, 208, 210 from an ADS-B system.

Data is processed for the own-ship 204 and, when received for the other aircraft 206, 208, 210 transmitting aircraft related parameters, such as within the ADS-B system, transmitted directly from the aircraft 206, 208, 210 or a distal source (not shown) such as ground stations or satellites. For this first exemplary embodiment of FIG. 2, the data comprises flight parameters including positional data (location and direction), speed, and aircraft type. An image representing the own-ship 204 and the aircraft 206, 208, 210 is displayed on the display area 200 in a location determined by the positional data. The display of the identification numbers (not shown) may be provided for aircraft 206, 208, 210 respectively, adjacent the aircraft's image 206, 208, 210, for example.

Figure 3:
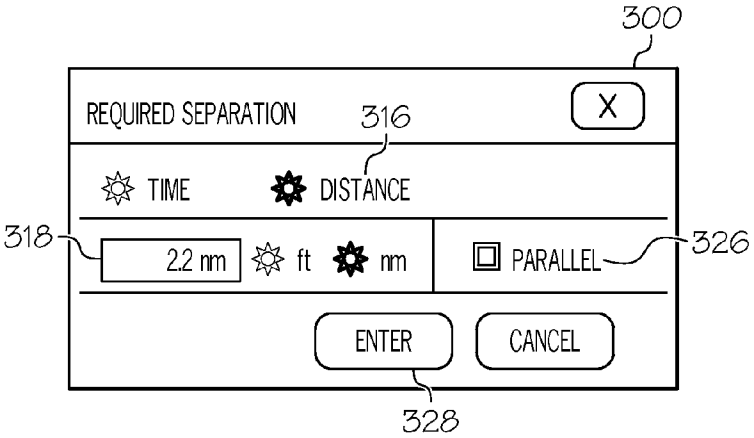
FIG. 3 is a first dialog box that may be displayed in accordance with the first exemplary embodiment.
Figure 4:
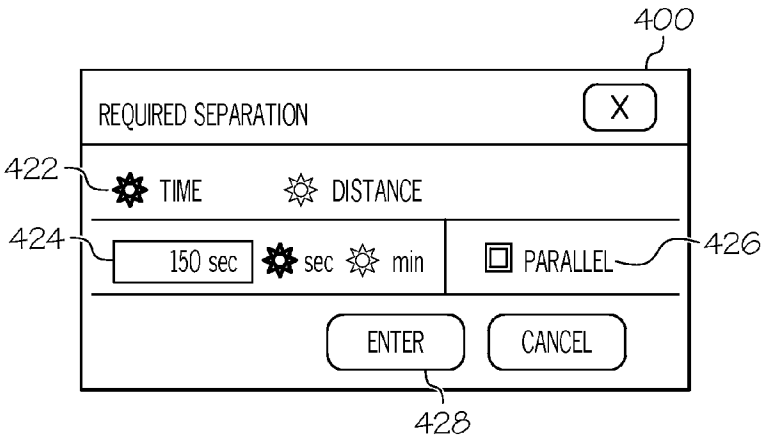
FIG. 4 is a second dialog box that may be displayed in accordance with the first exemplary embodiment.

The pilot may choose the appropriate traffic as the reference aircraft, in this case, aircraft 206, or it may be chosen by another source, for example, air traffic control (ATC). When the traffic symbol for aircraft 206 is selected, a task menu 212 shall indicate an option including a separation button 214. This selection may be accomplished in any one of several methods, such as touching on a touch screen or moving a cursor onto the call sign and selecting in a known manner. Once the pilot selects the separation button 214, a dialog box 300, 400 (FIGS. 3 and 4, respectively) is displayed for entering separation parameters depending on whether VSA or FIM operations are being utilized. For VSA operations (FIG. 3), the pilot will select Distance 316 and enter the distance 318, via the input 102, needed to maintain the required distance between the own-ship 204 and the selected aircraft 206. For FIM operations (FIG. 4), the pilot will select time 422 and enter the desired time 424 to be maintained between the own-ship 204 and the aircraft 206.

The format of each displayed aircraft 204, 206, 208, 210 is defined by the algorithm. The format may include different displayed sizes, colors, or images. For example, the own-ship 204 may be a first color, the selected aircraft 206 may be a second color, while the remaining displayed aircraft 208, 210 may be a third color. The own-ship 204 may assume a shape different from the other aircraft 204, 206, 208, 210 to further eliminate any possible confusion by the aircrew.

During the course of this description, like numbers may be used to identify like elements according to the different figures that illustrate the various exemplary embodiments.

Figure 5:
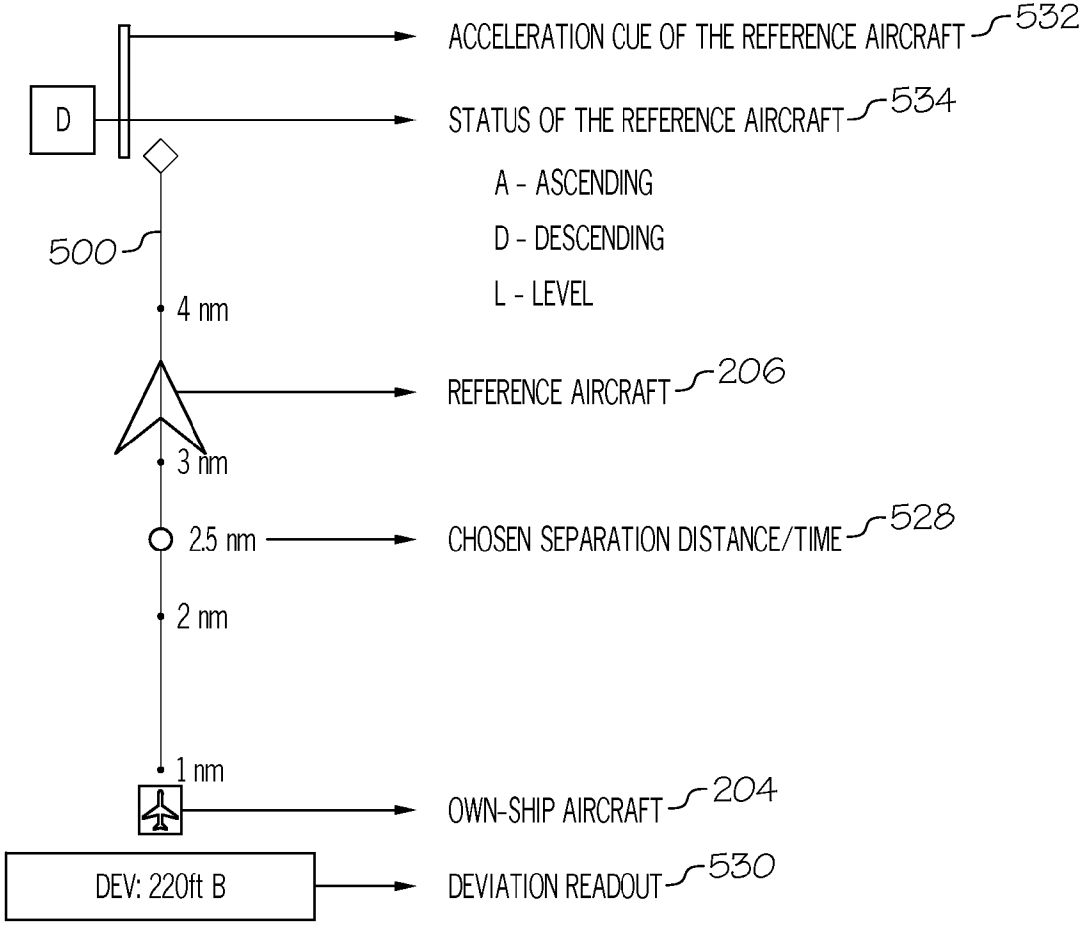
FIG. 5 is a longitudinal scale containing distance markers that may be displayed in accordance with the first exemplary embodiment.
Figure 6:
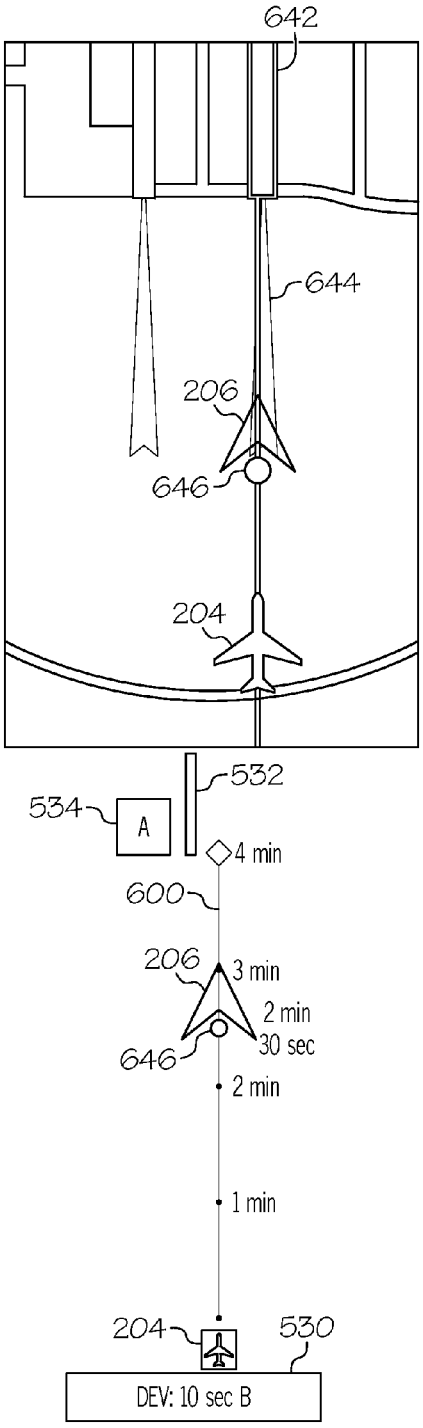
FIG. 6 is a longitudinal scale containing time markers having first aircraft parameters that may be displayed in accordance with a second exemplary embodiment.

Pressing the enter button 328 on the separation dialog box 300 shall display an enhanced longitudinal scale 500 as shown in FIG. 5, or pressing the enter button 428 on the separation dialog box 400, shall display an enhanced longitudinal scale 600 as shown in FIG. 6. The enhanced longitudinal scales 500, 600 can be placed at the right side of a lateral map/INAV display, for example, and includes a symbol for the own-ship 204. The enhanced longitudinal scales 500, 600 are divided into four sections, each comprising 1 nm (FIG. 5), for example, for distance separation, and 1 minute (FIG. 6), for example, for time separation. The scaling depends on the separation distance/time chosen in the separation dialog box 300, 400. For example, for VSA operations, the ideal zone is somewhere between 2 to 3 nm. If the chosen separation is 2.5 nm, a reference marker 528 shall be placed in the scale and marked as 2.5 nm.

An aircraft ADS-B/CDTI symbol moves along the scale that indicates the current position of the reference aircraft 206. Referring to FIG. 5, any deviation from the reference distance is given as readout 530 below the scale 500. The difference between the separation value and the reference aircraft may be displayed in formatted values. For example, if the difference is zero or small, the entire scale is drawn, for example, in green. If the difference is moderate, the scale is drawn, for example, in amber and if the difference is huge and the own-ship 204 is very close to the reference aircraft 206, the scale is drawn, for example, in red. The color of the reference aircraft 206 and scale will match the threat category of the aircraft as output by the TCAS system.

The reference aircraft 206 status is also displayed. If the reference aircraft 206 is accelerating or decelerating, an acceleration cue 532 of the reference aircraft 206 is drawn at the top of the scale 500. A line representing the acceleration cue 532 from the top of the scale 500 away from the own-ship 204 indicates acceleration, while a line from the top of the scale 500 towards the own-ship 204 indicates a deceleration. An indicator 534 is placed next to the acceleration cue 532 that indicates whether the reference aircraft is in level flight, ascending, or descending. For example, the letter L for level flight, the letter A for ascending, and the letter D for descending may be used.

Figure 7:
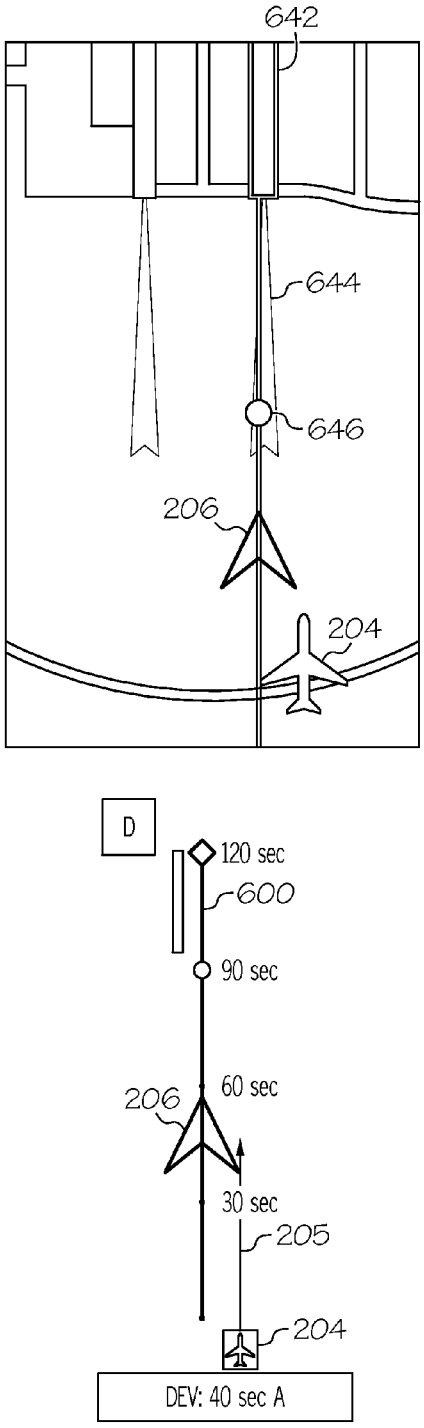
FIG. 7-9 are longitudinal scales containing time markers having second, third, and fourth aircraft parameters, respectively.
Figure 8:
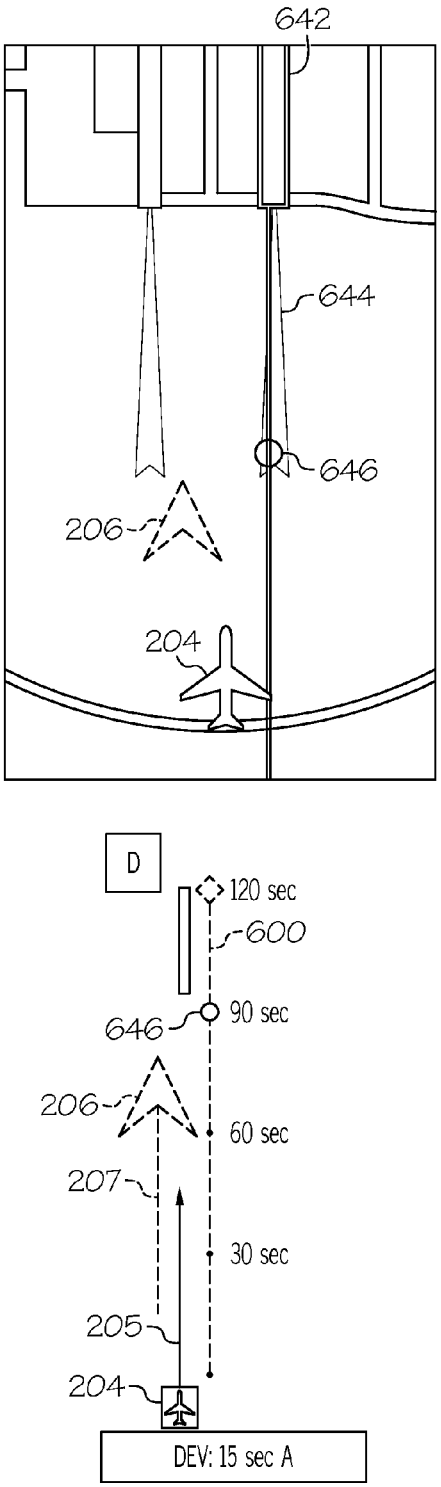
Figure 9:
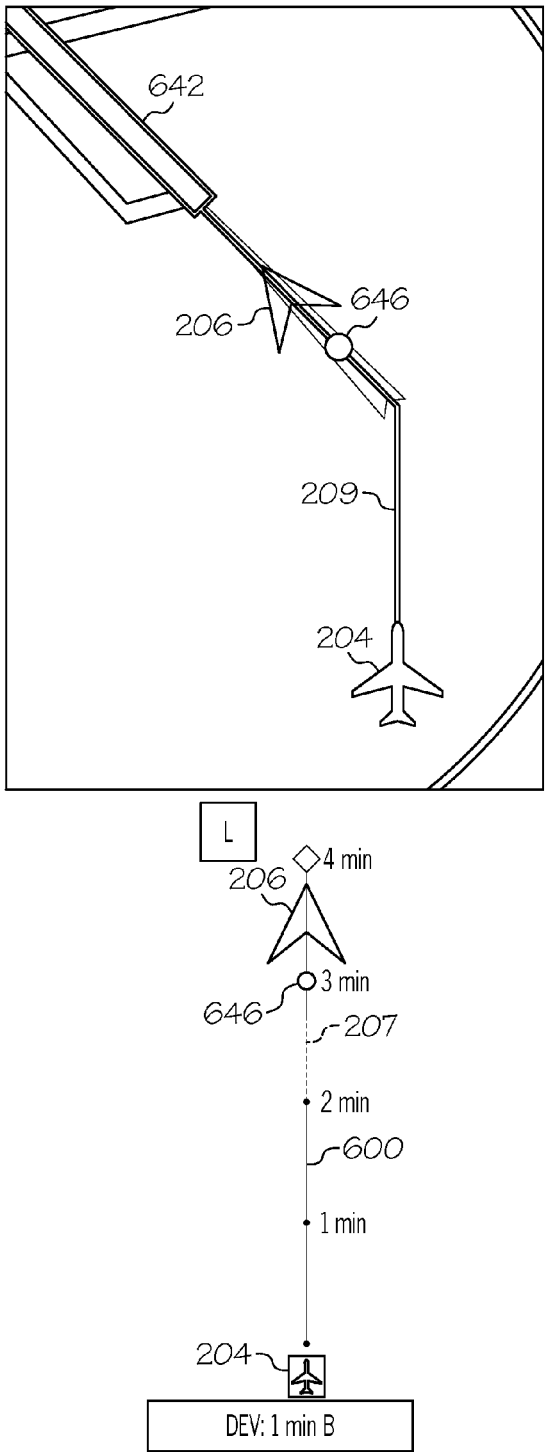

Various scenarios for a time separated straight-in approach are illustrated in FIGS. 6-9. A cutout from a lateral map (INAV) display is shown at the top of each of the FIGS. 6-9, and shows the selected runway 642 for landing as well as the flight plan TO/Active segment 644. The separation dot 646 on the active flight plan segment 600 is also displayed on the lateral map. Curved transitions 207 on the scale 600 are shown as stippled lines (FIG. 9).

For parallel operations, the pilot can select parallel 326, 426 on the respective separation dialog box 300, 400. Various scenarios for a distance separated parallel approach are shown in FIGS. 10-13. The separation distance/time is shown with an offset line and dot 646 on the active flight plan segment 600 to indicate that it is a parallel operation. Additional symbols, for example the final approach fix 647 may also be shown on the scale 600.

More specifically, FIG. 6 illustrates the reference aircraft 206 accelerating (per the accelerating cue 532), is ascending (indicator 534), and in a position ahead of the own-ship 204 by a deviation of plus 10 seconds (readout 530) and as shown by the separation dot 646 (the reference aircraft 206 is ahead of the dot 646).

FIG. 7 illustrates the reference aircraft 206 decelerating (per the accelerating cue 532), descending (indicator 534), and in a position ahead of the own-ship 204 by a deviation of minus 40 seconds (readout 530) and as shown by the separation dot 646 (the aircraft 206 is behind the dot 646).

FIG. 8 illustrates the reference aircraft 206 decelerating (per the accelerating cue 532), descending (indicator 534), and in a position ahead of the own-ship 204 by a deviation of minus 15 seconds (readout 530) and as shown by the separation dot 646 (the aircraft 206 is behind the dot 646).

FIG. 9 illustrates the reference aircraft 206 neither accelerating nor decelerating (per the accelerating cue 532), in level flight (indicator 534), and in a position ahead of the own-ship 204 by a deviation of plus 1 minute (readout 530) and as shown by the separation dot 646 (the aircraft 206 is ahead of the dot 646). Since the deviation of the time between the own-ship 204 and the aircraft 206 is small or greater than desired, the format (color may be green) indicates a good separation, while the color of FIG. 7 would be red indicating the deviation is less than required by a margin beyond a threshold, and the color of FIG. 8 would be amber indicating the deviation is less than required, but less than a threshold. Note the stippled line 205 in FIGS. 7 and 8 illustrate the track of the own-ship 204 that is offset from the desired track 600, while the stippled line 207 illustrates the track of the reference aircraft 206. The stippled line 209 in FIG. 9 illustrates a required curved transition to accomplish the desired track 600.

Figure 10:
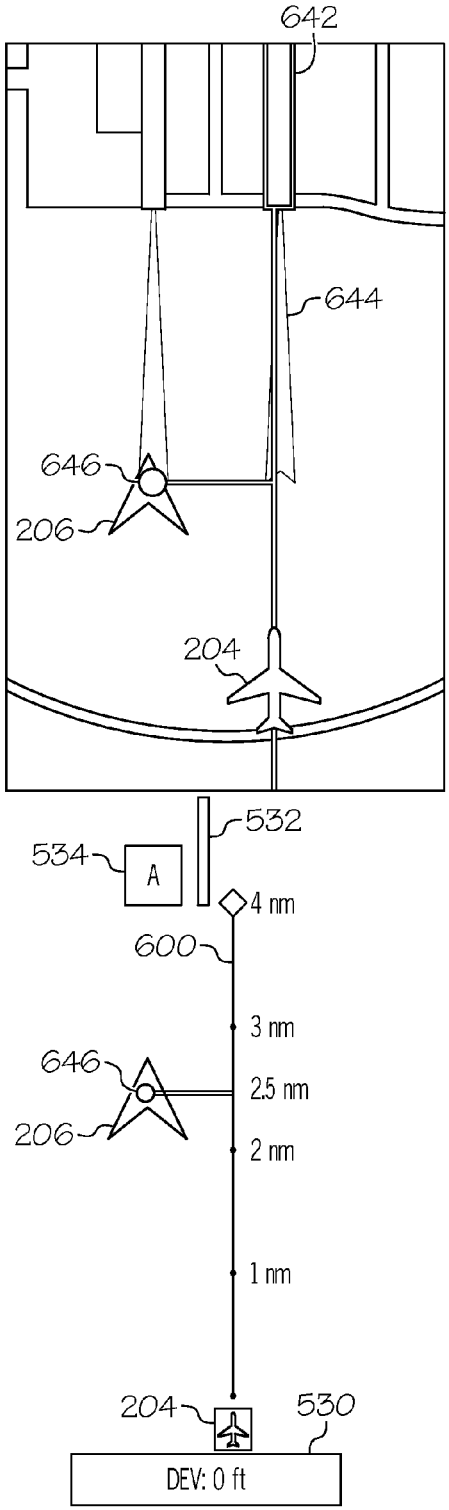
FIGS. 10-13 are longitudinal scales containing distance markers having fifth, sixth, seventh, and eighth aircraft parameters, respectively.

FIG. 10 illustrates the reference aircraft 206 accelerating (per the accelerating cue 532), ascending (indicator 534), and in a position ahead of the own-ship 204 by zero deviation (readout 530) and as shown by the separation dot 646 (the aircraft 206 is abreast the dot 646).

Figure 11:
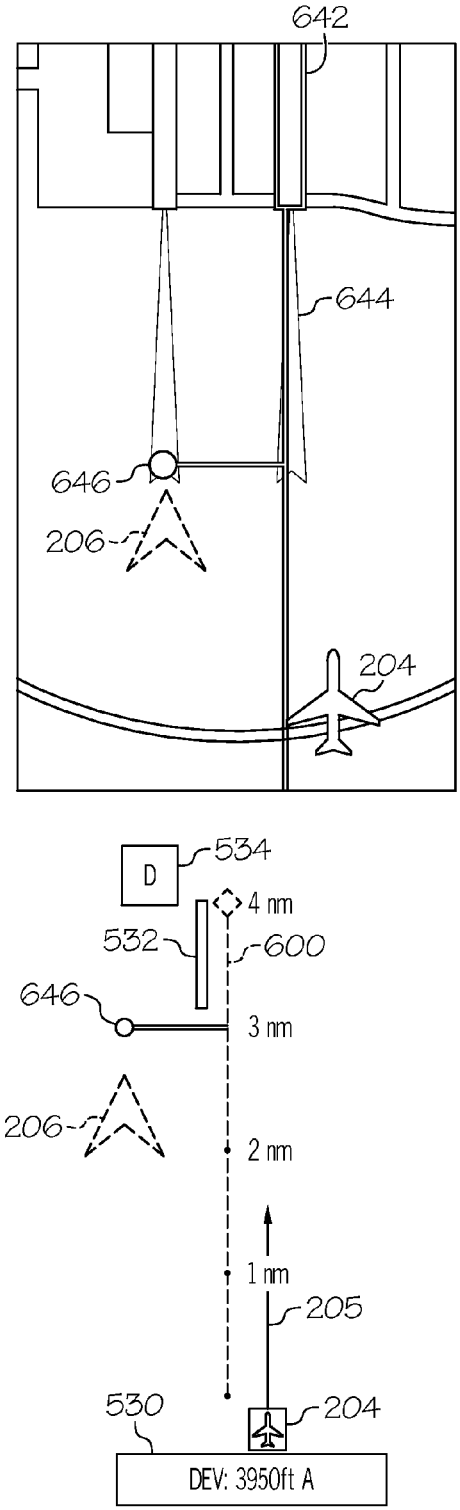

FIG. 11 illustrates the reference aircraft 206 decelerating (per the accelerating cue 532), descending (indicator 534), and in a position ahead of the own-ship 204 by a deviation of minus 3950 feet (readout 530) and as shown by the separation dot 646 (the aircraft 206 is behind the dot 646).

Figures 12, 13:
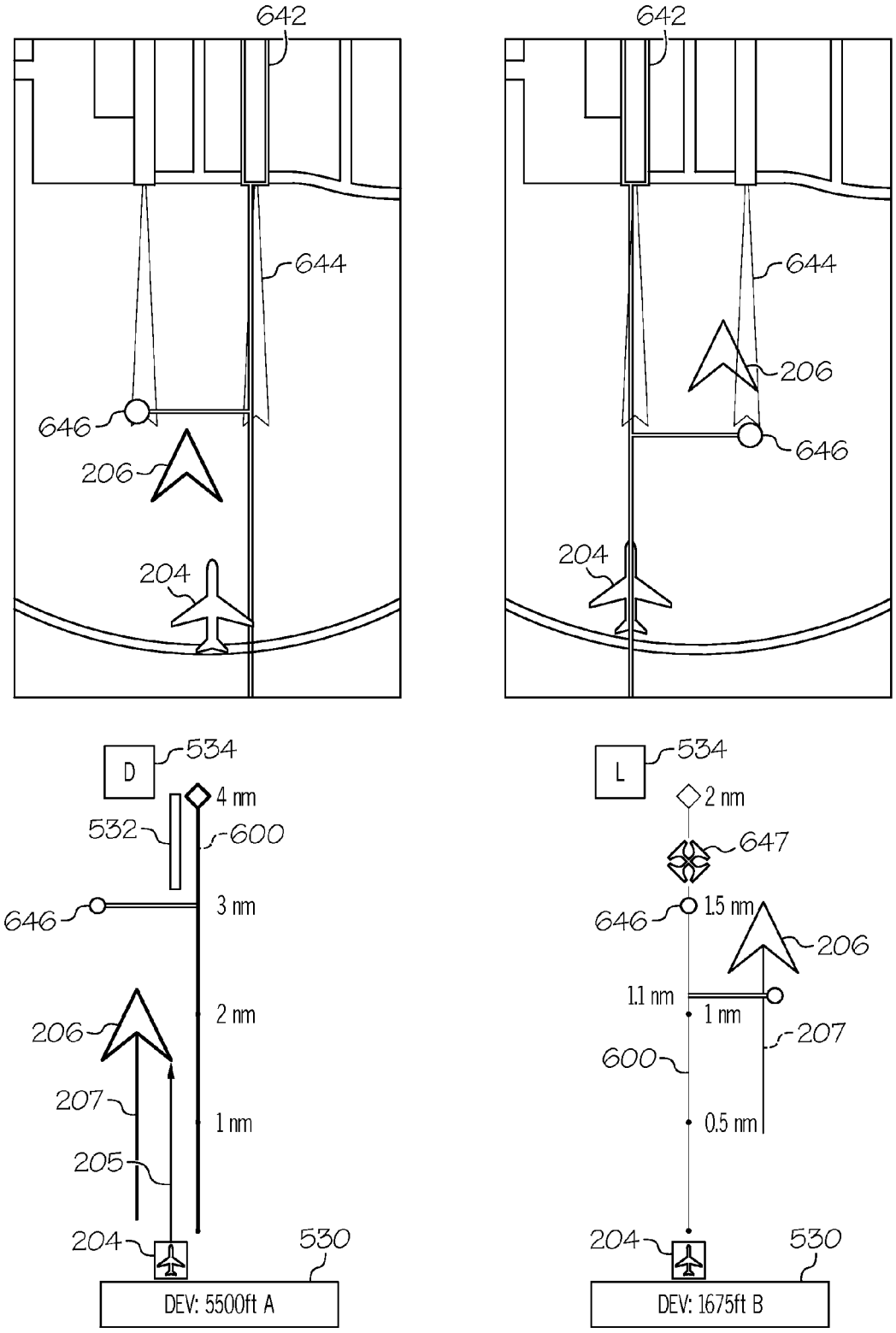

FIG. 12 illustrates the reference aircraft 206 decelerating (per the accelerating cue 532), descending (indicator 534), and in a position ahead of the own-ship 204 by a deviation of minus 5500 feet (readout 530) and as shown by the separation dot 646 (the aircraft 206 is behind the dot 646).

FIG. 13 illustrates the reference aircraft 206 neither accelerating nor decelerating (per the accelerating cue 532), in level flight (indicator 534), and in a position ahead of the own-ship 204 by a deviation of plus 1675 feet (readout 530) and as shown by the separation dot 646 (the aircraft 206 is ahead of the dot 646). Since the deviation of the time between the own-ship 204 and the aircraft 206 in FIGS. 10 and 13 is small or greater than desired, the format (color may be green) indicates a good separation, while the color of FIG. 12 would be red indicating the deviation is less than required by a margin beyond a threshold, and the color of FIG. 11 would be amber indicating the deviation is less than required, but less than a threshold. Note the line 205 in FIGS. 11-13 illustrate the track of the own-ship 204 that is offset from the desired track of the scale 600.

Figure 14:
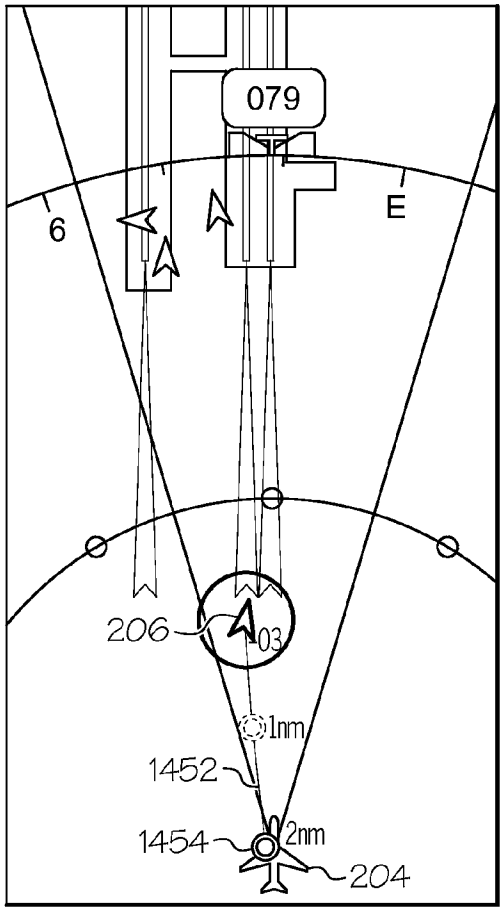
FIGS. 14-16 are conformal separation scales displaying aircraft separation for various aircraft parameters.
Figure 15:
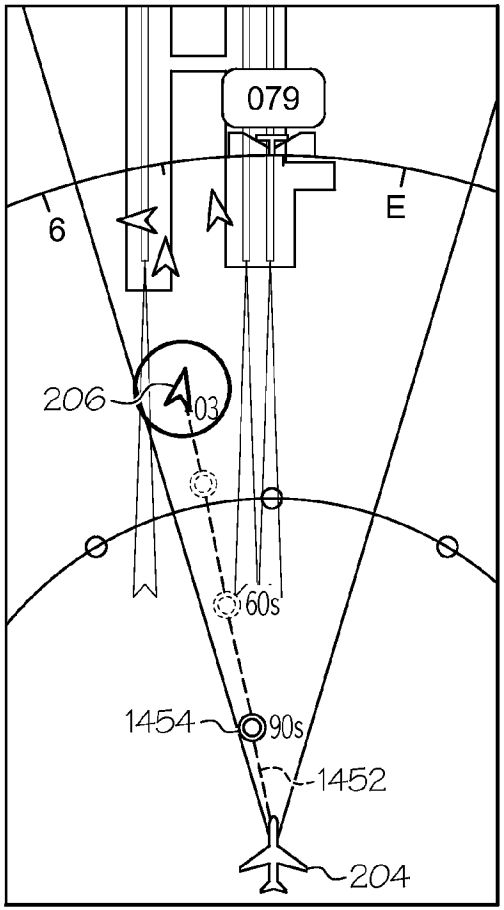
Figure 16:
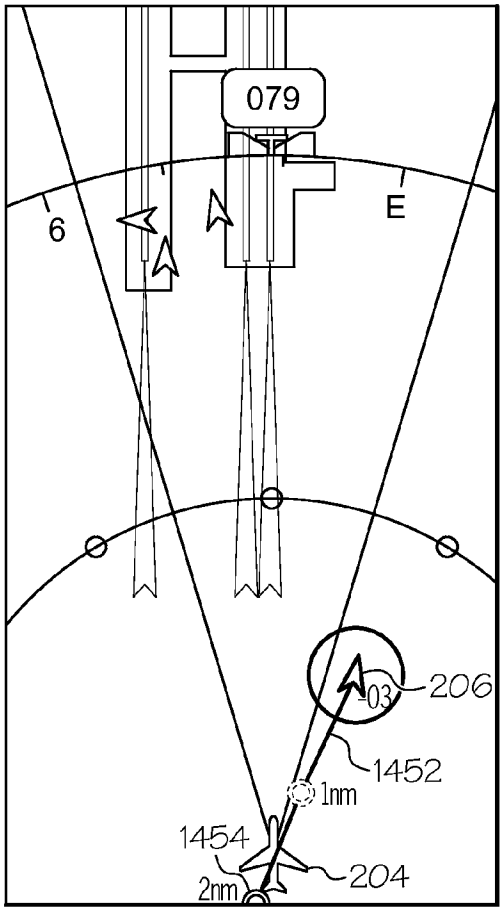

A conformal separation scale, in accordance with yet another exemplary embodiment, may also be displayed as shown in FIGS. 14-16. A guidance line 1452 is drawn from the own-ship 204 to the reference aircraft 206. A dot 1454 is displayed that serves as the chosen separation distance (FIG. 14, 16) or time (FIG. 15). Preferably, the pilot of the own-ship 204 will maneuver to position the own-ship 204 on the dot 1454 to maintain the desired separation. The dot 1454 on the lateral map of FIG. 15 corresponds to the 1 minute, 30 second mark of the reference time chosen in the separation dialog box 400. Based on the location of the reference aircraft 206 with respect to the reference distance/time, the guidance line 1452 may be color coded. If the own-ship 204 is too close to the reference aircraft and/or is between the reference aircraft 206 and the dot (reference point) 1454 the guidance line 1452 can be displayed is a format that alerts the pilot, for example, a flashing red. And if the own-ship 204 is too far from the reference aircraft 206 and dot 1454, it can be drawn in a different format.

Figure 17:
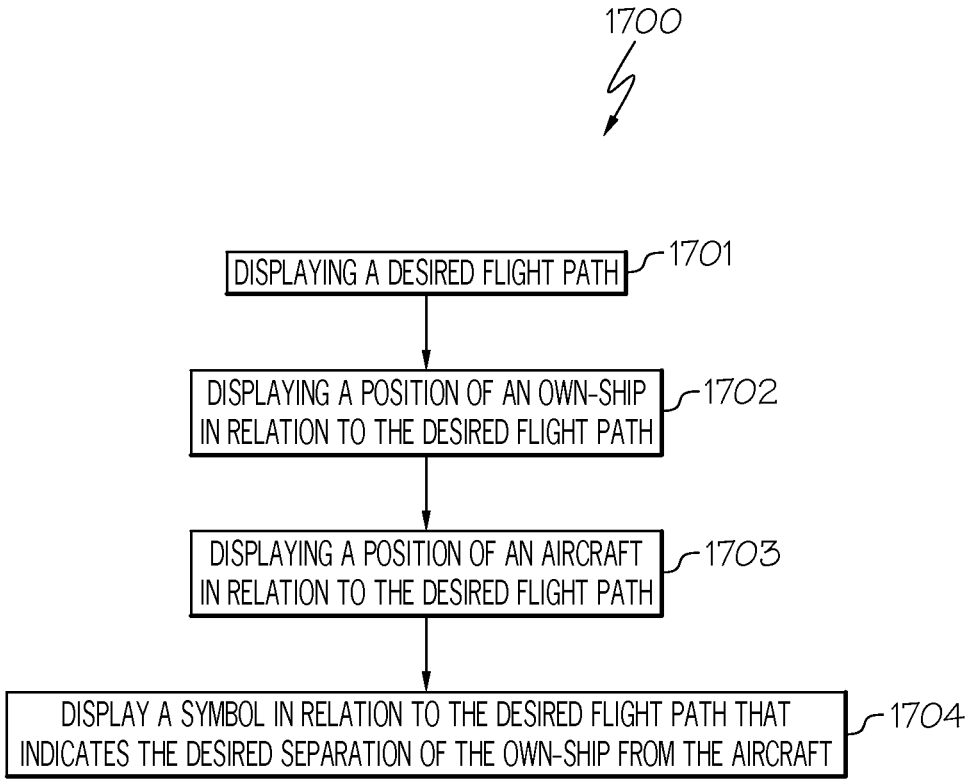
FIG. 17 a flow diagram of an exemplary method suitable for use with the display system of FIG. 1 in accordance with the exemplary embodiments.

FIG. 17 is a flow chart that illustrates an exemplary embodiment of a method 1700 suitable for use with a flight deck display system 100. Method 1700 represents one implementation of a method for displaying aircraft approaches or departures on an onboard display of a host aircraft. The various tasks performed in connection with method 1700 may be performed by software, hardware, firmware, or any combination thereof. For illustrative purposes, the following description of method 1700 may refer to elements mentioned above in connection with preceding FIGS. In practice, portions of method 1700 may be performed by different elements of the described system, e.g., a processor, a display element, or a data communication component. It should be appreciated that method 1700 may include any number of additional or alternative tasks, the tasks shown in FIG. 17 need not be performed in the illustrated order, and method 1700 may be incorporated into a more comprehensive procedure or method having additional functionality not described in detail herein. Moreover, one or more of the tasks shown in FIG. 17 could be omitted from an embodiment of the method 1700 as long as the intended overall functionality remains intact.

In accordance with the exemplary method of FIG. 17, the method 1700 for displaying a desired separation of an own-ship from an aircraft, comprises displaying 1701 a desired flight path, displaying 1702 a position of the own-ship in relation to the desired flight path, displaying 1703 a position of the aircraft in relation to the desired flight path, and displaying 1704 a symbol in relation to the desired flight path that indicates the desired separation of the aircraft from the own-ship.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A method for displaying a desired separation of an own-ship from an aircraft, comprising:

displaying a longitudinal scale comprising:

displaying a desired flight path;

displaying a position of the own-ship in relation to the desired flight path;

displaying a position of the aircraft in relation to the desired flight path, the position being determined from aircraft related parameters transmitted by the aircraft;

displaying an index on the desired flight path indicating a desired separation for the aircraft from the own-ship; and displaying a portion of the desired flight path in a unique format when defining at least one of a change in heading and altitude for the desired flight path.

2. The method of claim 1 wherein displaying a longitudinal scale further comprises:

displaying an indication of whether a velocity of the aircraft is changing.

3. The method of claim 1 wherein displaying a longitudinal scale further comprises:

displaying an indication whether a distance between the own-ship and the aircraft is changing.

4. The method of claim 1 wherein displaying a longitudinal scale further comprises:

displaying markers on the desired flight path indicating one of a distance between markers or a time required to flight between markers by the own-ship.

5. The method of claim 1 wherein displaying a longitudinal scale further comprises:

displaying an aircraft actual flight path when the aircraft is off of the desired flight path.

6. The method of claim 1 wherein displaying a longitudinal scale further comprises:

displaying an own-ship actual flight path when the own-ship is off of the desired flight path.

7. The method of claim 1 wherein displaying a longitudinal scale further comprises:

displaying a portion of an actual flight path in a different format from the desired flight path to indicate a change of aircraft or own-ship heading change.

8. The method of claim 1 wherein displaying a longitudinal scale further comprises:

displaying the desired flight path is a format relative to the distance between the aircraft and the own-ship to a desired distance.

9. A method for displaying a desired separation of an own-ship from an aircraft, comprising:

displaying a longitudinal scale representing a desired flight path;

displaying a position of the own-ship in relation to the desired flight path, the position being determined in response to aircraft related parameters transmitted by the aircraft;

displaying a position of the aircraft in relation to the desired flight path;

displaying a symbol in relation to the desired flight path that indicates the desired separation of the aircraft from the own-ship; and displaying a portion of the desired flight path in a unique format when defining at least one of a change in heading and altitude for the desired flight path.

10. The method of claim 9 further comprising:

displaying an indication whether a distance between the own-ship and the aircraft is changing.

11. A system for displaying a desired separation of an own-ship from an aircraft, comprising:

a display;

a navigation system configured to determine a location of the own-ship and the aircraft;

a processor coupled to the display and the navigation system, and configured to display a longitudinal scale comprising:

a desired flight path;

a position of the own-ship in relation to the desired flight path;

a position of the aircraft in relation to the desired flight path, the position determined in response to aircraft related parameters transmitted by the aircraft; and a symbol in relation to the desired flight path that indicates the desired separation of the aircraft from the own-ship;

wherein a portion of the desired flight path comprises a unique format when defining at least one of a change in heading and altitude for the desired flight path.

12. The system of claim 11 wherein the processor is further configured to display the longitudinal scale further comprising an indication of whether a velocity of the aircraft is changing.

13. The system of claim 11 wherein the processor is further configured to display the longitudinal scale further comprising an indication whether a distance between the own-ship and the aircraft is changing.

14. The system of claim 11 wherein the processor is further configured to display the longitudinal scale further comprising markers on the desired flight path indicating one of a distance between markers or a time required to flight between markers by the own-ship.

15. The system of claim 11 wherein the processor is further configured to display the longitudinal scale further comprising an aircraft actual flight path when the aircraft is off of the desired flight path.

16. The system of claim 11 wherein the processor is further configured to display the longitudinal scale further comprising an own-ship actual flight path when the own-ship is off of the desired flight path.

17. The system of claim 11 wherein the processor is further configured to display the longitudinal scale further comprising a portion of an actual flight path in a different format from the desired flight path to indicate a change of aircraft or own-ship heading change.

18. The system of claim 11 wherein the processor is further configured to display the longitudinal scale further comprising the desired flight path is a format relative to the distance between the aircraft and the own-ship to a desired distance.

* * * * *